US008038280B2

(12) United States Patent
Scarlata

(10) Patent No.: US 8,038,280 B2
(45) Date of Patent: Oct. 18, 2011

(54) INK-JET PRINTER AND METHOD FOR DECURLING CUT SHEET MEDIA PRIOR TO INK-JET PRINTING

(75) Inventor: Richard F. Scarlata, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 809 days.

(21) Appl. No.: 12/100,132

(22) Filed: Apr. 9, 2008

(65) Prior Publication Data

US 2009/0256896 A1 Oct. 15, 2009

(51) Int. Cl.
*B41J 2/01* (2006.01)

(52) U.S. Cl. ..... 347/101; 347/104; 347/105

(58) Field of Classification Search ..... 347/101, 347/104, 105; 271/161, 188, 209; 399/406
See application file for complete search history.

(56) References Cited

U.S. PATENT DOCUMENTS

| | | | | | |
|---|---|---|---|---|---|
| 3,986,452 | A | | 10/1976 | Dahlgren | |
| 4,207,143 | A | * | 6/1980 | Glomb et al. | 162/207 |
| 4,596,632 | A | * | 6/1986 | Goetz et al. | 162/136 |
| 4,652,110 | A | * | 3/1987 | Sato et al. | 399/406 |
| 5,264,899 | A | * | 11/1993 | Mandel | 399/341 |
| 5,764,263 | A | * | 6/1998 | Lin | 347/101 |
| 5,797,318 | A | | 8/1998 | Taylor et al. | |
| 5,842,105 | A | | 11/1998 | Acquaviva | |
| 5,850,589 | A | * | 12/1998 | Cruz et al. | 399/341 |
| 5,987,301 | A | * | 11/1999 | Acquaviva | 399/406 |
| 6,094,560 | A | | 7/2000 | Thomas | |
| 6,246,860 | B1 | * | 6/2001 | Ohmichi | 399/406 |
| 6,338,481 | B1 | * | 1/2002 | Maruchi | 271/188 |
| 6,668,155 | B1 | * | 12/2003 | Hubble et al. | 399/406 |
| 7,376,383 | B2 | * | 5/2008 | Segerer et al. | 399/407 |
| 7,460,824 | B2 | * | 12/2008 | Nakajima et al. | 399/341 |
| 7,510,610 | B2 | * | 3/2009 | Kougami et al. | 118/264 |
| 2003/0137573 | A1 | | 7/2003 | Rasmussen et al. | |
| 2004/0245711 | A1 | | 12/2004 | Domoto et al. | |
| 2006/0214958 | A1 | * | 9/2006 | Inoue | 347/5 |

* cited by examiner

*Primary Examiner* — Matthew Luu
*Assistant Examiner* — Rut Patel
(74) *Attorney, Agent, or Firm* — Fay Sharpe LLP

(57) ABSTRACT

Ink-jet printing systems and methods are presented for decurling cut sheet print media for ink-jet printing, in which the cut sheets are transported along a path with a moisture source directing water droplets or mist toward all or a portion of a first side of the sheets in a moisturizing zone extending across the path to decurl the sheets prior to transportation past an ink-jet printing head with the first side of the cut sheets facing the printing head to receive ink droplets ejected by the printing head.

19 Claims, 3 Drawing Sheets

INK-JET PRINTER AND METHOD FOR DECURLING CUT SHEET MEDIA PRIOR TO INK-JET PRINTING

BACKGROUND

The present exemplary embodiment relates to ink-jet printers and more particularly to decurling apparatus and techniques for flattening or decurling cut sheet print media prior to transportation past an ink-jet printing head. Printing using ink-jet printing heads requires precise control over the spacing between the printing head and the print media on which ink-based images are to be printed. The desired spacing between the print head and the media, moreover, is typically very small, such as on the order of 50 to 100 um. Thus, media handling is a challenge for ink-jet printers to prevent the print media sheets from impacting the ink-jet head and to attain good image registration while placing ink droplets precisely on the sheet. Because the distance between the print head and the media support/transport mechanism is so small in ink-jet printers, reliable insertion of the sheet into the printing gap is important for cut sheet systems. This situation is aggravated by fed media being curled prior to insertion into the printing gap. The leading edge of the cut sheet is particularly susceptible to contacting the printing head when a fed sheet is curled upward before introduction into the printing gap. Thus, there is a need for improved ink-jet printers and methods to mitigate contact between ink-jet printing heads and cut sheet printable media while allowing proper image registration and image quality control.

BRIEF DESCRIPTION

The present disclosure provides ink-jet printing systems and methods for decurling cut sheet print media for ink-jet printing, in which all or a portion of the top side of the cut sheet is moisturized prior to transport under the printing head to decurl the sheet downward away from the printing head. In accordance with one or more aspects of the present disclosure, a printing system is provided, which is comprised of one or more ink-jet printing heads which operate to eject ink droplets toward a printable media path, and a cut sheet transport system that is spaced from the printing head and which transports cut sheets along the path with a first side of the sheets facing the printing head to receive ejected ink droplets. The system also includes a moisture source to direct water droplets or mist toward the first side of the cut sheets in a moisturizing zone extending across the path upstream from the printing head. In one or more exemplary embodiments, the cut sheet transport system includes a vacuum blower providing airflow to provide vacuum attraction of a second side of the cut sheets toward the sheet transport system. In certain implementations, moreover, the moisturizing zone extends across the path upstream of the cut sheet transport system, and the system may include a controller to control a sheet transport speed of the transport system and to control an amount of moisture transferred to the cut sheets. The moisture source in certain embodiments, moreover, may be operative to direct water droplets or mist toward less than all of the first side of the cut sheets moving along the path, such as a portion including a leading edge of the cut sheets in a coordinated fashion to achieve a desired cut sheet decurling. In certain embodiments, moreover, the system may include an optional dryer element situated between the moisture source and the printing head to dry the decurled cut sheets prior to the printing process.

Further aspects of the disclosure provide a method of decurling cut sheet print media for ink-jet printing. The method includes transporting one or more cut sheets along a path, decurling the cut sheets by directing water droplets or mist toward at least a portion of a first side of the cut sheets in a moisturizing zone extending across the path, and transporting the decurled cut sheets past an ink-jet printing head with the first side of the cut sheets facing the printing head to receive ink droplets ejected by the printing head. In certain implementations, the decurling involves directing water droplets or mist toward less than all of the first side of the cut sheets moving along the path, such as a portion including a leading edge of the cut sheets, and the cut sheet transportation includes providing a vacuum force attracting a second side of the cut sheets. The method may further include controlling the speed at which the cut sheets are transported along the path and controlling the amount of moisture transferred to the cut sheets. The method in certain embodiments may further include wholly or partially drying the cut sheets after decurling and prior to transporting the decurled cut sheets past the ink-jet printing head.

BRIEF DESCRIPTION OF THE DRAWINGS

The present subject matter may take form in various components and arrangements of components, and in various steps and arrangements of steps. The drawings are only for purposes of illustrating preferred embodiments and are not to be construed as limiting the subject matter.

DETAILED DESCRIPTION

Figure 1:
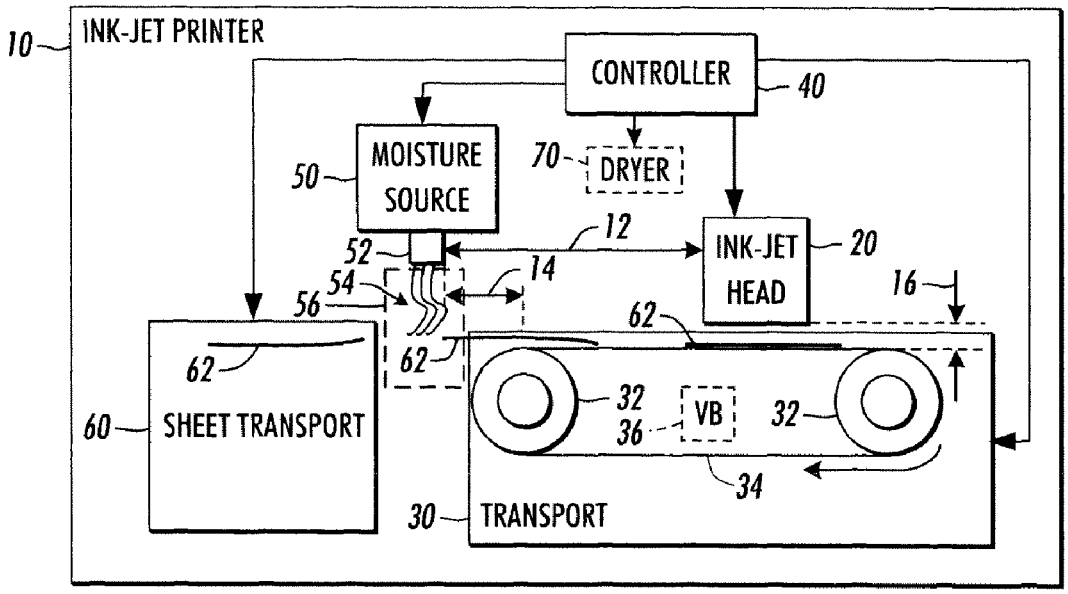
FIG. 1 is a simplified side elevation view illustrating an exemplary ink-jet printing system for printing on cut sheet printable media including a moisturizing apparatus for decurling cut sheet media prior to introduction into an ink-jet printing gap in accordance with various aspects of the present disclosure.

Several embodiments or implementations of the present disclosure are hereinafter described in conjunction with the drawings, wherein like reference numerals are used to refer to like elements throughout, and wherein the various features, structures, and graphical renderings are not necessarily drawn to scale. The disclosure relates to ink-jet printing and control over introduction of cut sheet print media into a printing gap under one or more ink-jet printing heads, and provides systems and techniques for decurling fed cut sheets by pre-moisturizing a top side of the sheets prior to transport under the print head. While not wishing to be tied to any particular theory, application of moisture to the top of the cut sheets is believed to cause the fibers in the sheet to swell on the moistened side while the dry side fibers remain the same size, thereby causing a bending away from the sprayed side. Thus, sheets that are initially curled upward (concave upper side) will tend to be flattened and even curled downward by providing spray droplets or water mist from above. In this respect, the successful capture of a leading edge of the cur sheets is facilitated by applying moisture to at least a leading portion of the top side of the cut sheet prior to introduction into the printing gap under the ink-jet printing head. In this manner, the present disclosure can be advantageously employed to mitigate undesirable contact between the sheets and the print head and to facilitate transport of the cut sheets at a controlled spacing from the print head for reliable print image control.

The moisturizing techniques of the disclosure can be employed alone or in combination with vacuum-type transport mechanisms, wherein the inventor has appreciated that use of a vacuum transport alone does not ensure successful capture of the lead edge of a sheet that has a lot of curl, particularly upward curl. However, the pre-moistening of the leading edge or the entire tope surface of a cut sheet is particularly advantageous in combination with vacuum transport mechanisms, where the water droplets and/or mist is preferably provided somewhat upstream from the vacuum transport apparatus so that the leading edge of the cut sheet is flattened, or curling downward, or has less of an upward curl than it had prior to moisture introduction, when the sheet encounters the vacuum force to assist in successful capture of the leading edge.

Referring now to the drawings, FIGS. 1-4 depict an exemplary ink-jet printing system 10 having decurling apparatus in accordance with various aspects of the present disclosure. As best shown in FIG. 1, the printing system 10 is comprised of at least one ink-jet printing head 20 operative to eject ink droplets in a generally downward direction toward a printable media path along which one or more cut sheets 62 are traveling (e.g., from left to right in FIG. 1). The system 10 also includes a cut sheet transport system 30 vertically spaced from the printing head 20 by a distance 16. The sheets 62 are provided to the printing portion of the system 10 from an upstream sheet transport mechanism 60 and are transferred to the transport system 30 for transporting the sheets 62 along the path with a first (top or upper) side of the cut sheets 62 facing the printing head 20 to receive ejected ink droplets (not shown) therefrom.

The ink-jet head 20 can be any suitable form or type of ink-jet device, and more than one head 20 may be included in the system 10 along with other ink-jet printer components, where the details of such additional components are omitted from the drawings in order to avoid obscuring the various decurling aspects of the present disclosure. The printing head 20 may comprise one or more drop generators (not shown) that emit ink droplets downward toward the cut sheet print media 62 being transported along the path under the head 20. In one possible implementation, on-board ink reservoirs (not shown) provide ink to the printhead(s) 20 via pressure and/or gravity for selectively emission by the head(s) 20 to the cut sheet print media 62 in accordance with a print job. The exemplary transport system 30 includes rollers 32 and at least one belt 34 operative to move the print media sheets 52 relative to the printhead 20, although other suitable transport system configurations and components may be employed within the scope of the present disclosure.

The system 10 further includes a moisture source 50 in accordance with the disclosure. The source 50 comprises an outlet 52, such as one or more apertures, pressurized spray nozzles, etc., spaced from and generally above the path, where the outlet 52 is operative to direct water droplets or mist 54 in a controlled fashion toward all or a portion of the first side of the cut sheets 62 as they move along the path in a moisturizing zone 56 that extends across the path upstream from the printing head 20. In the illustrated embodiment, moreover, the moisture source 50 is positioned somewhat upstream of the transport system 30 such that the moisturizing zone 56 extends across the path upstream from transport system 30.

Figure 2:
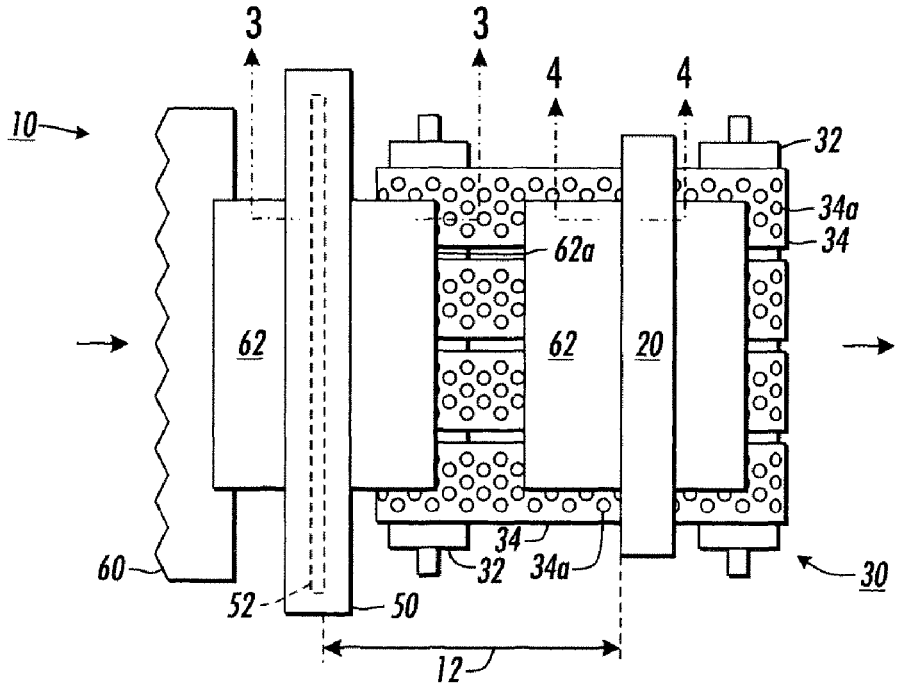
FIG. 2 is a partial top plan view illustrating a portion of the ink-jet printing system of FIG. 1 with a vacuum sheet transport system receiving moistened cut sheets and transporting the sheets under an ink-jet printing head.
Figure 3:
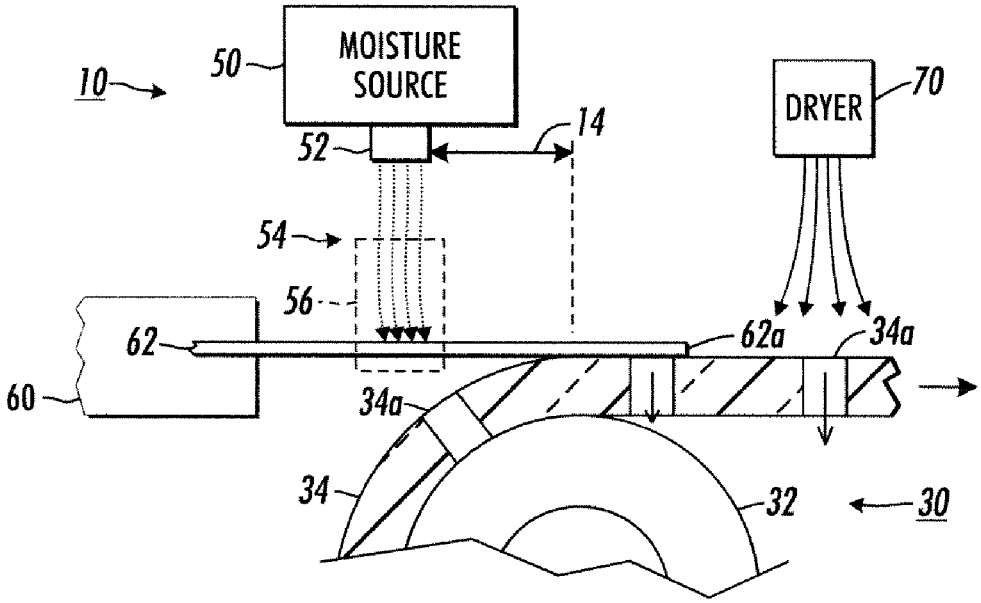
FIG. 3 is a partial sectional side elevation view taken along line 3-3 in FIG. 2 illustrating further details of the moisture source directing water droplets or mist in a moisturizing zone upstream of the vacuum transport system.
Figure 4:
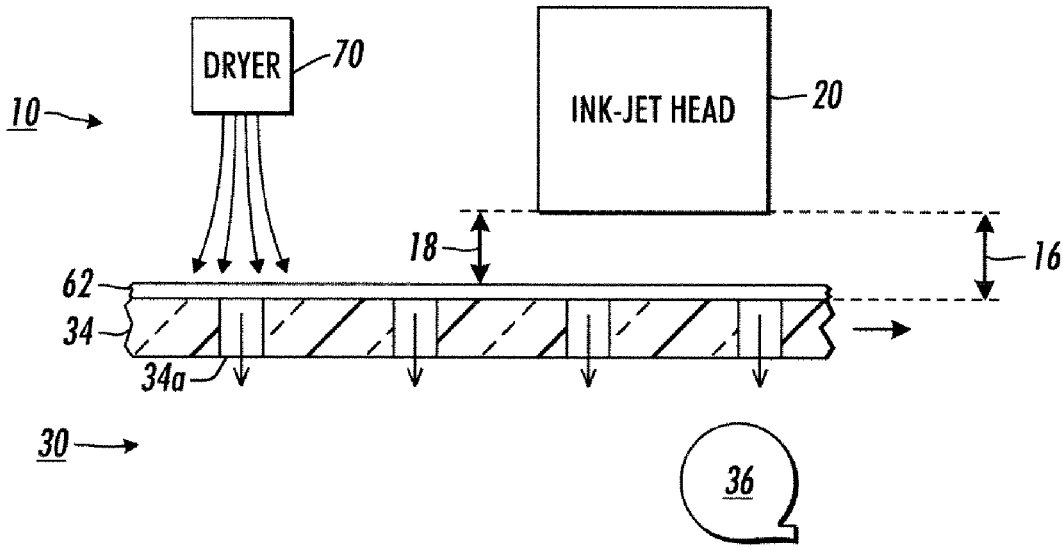
FIG. 4 is a partial sectional side elevation view taken along line 4-4 in FIG. 2 illustrating further details of the ink-jet printing head under which the moisturized cut sheet is transported for printing.

The moisture source 50 may provide the water droplets and/or mist in any suitable fashion, for example, using gravity and/or pressure for emitting moisture in a direction toward the upper side of the sheet media 62 travelling under the head 20. In a preferred embodiment, the outlet 52 of the moisture source 50 is laterally spaced from the receiving point of the transport 30 by a distance 14 (FIGS. 1 and 3), although not a strict requirement of the disclosure, wherein other embodiments are possible within the scope of the present disclosure in which water droplets and/or mist 54 is provided to all or a portion of the upper side of the cut sheets 62 in a moisturizing zone that overlies a portion of the belt 34 beyond the flat portion of the belt 34. The outlet 52 of the source 50, moreover, is laterally spaced by a distance 12 (FIGS. 1 and 2) upstream of the ink-jet printing head 20. As shown in FIGS. 1, 3, and 4, moreover, various embodiments of the system 10 may optionally include a dryer 70 spaced from the path (above the path in the illustrated examples, although not a strict requirement of the disclosure) and situated between the moisture source 50 and the printing head 20.

The dryer 70 is operative to wholly or partially dry the decurled cut sheets 62 moving along the path downstream of the moisturizing zone 56 prior to introduction thereof into the printing gap 18 (FIG. 4) under the printing head 20. The dryer 70 may be any suitable apparatus that at least partially dries the cut sheets 62, including without limitation one or more blowers to direct air at least partially toward the sheets 62 between the moisture source 50 and the printing head 20, heating apparatus to heat all or a portion of the sheets 62, a combination heater/blower, etc. The dryer 70, moreover, may be located anywhere between the source 50 and the ink-jet head 20, which may be located over a portion of the transport 30, although not a strict requirement of the disclosure.

The printing system 10 further includes a controller 40 (FIG. 1) operatively coupled with the cut sheet transport system 30, the moisture source 50, the printing head 20, the upstream transport mechanism 60, and the optional dryer 70, where the controller 122 may be any suitable form of hardware, software, firmware, programmable logic, or combinations thereof, whether unitary or implemented in distributed fashion in a plurality of components, wherein all such implementations are contemplated as failing within the scope of the present disclosure and the appended claims.

The controller 40 is operative to control a sheet transport speed of the transport system 30 and to control an amount of moisture transferred to the cut sheets 62. In one embodiment, the speed of the transport system 30 and that of the upstream mechanism 60 are the same, and the controller 40 controls the amount of moisture applied to each cut sheet 62 based at least partially on the sheet transport speed. In particular, the exemplary controller 40 controls the applied moisture amount (e.g., by controlling the dispensing or spray rate commensurate with the feeding/transport speed of the transported cut sheets 62) such that initially up-curled sheets 62 are preferably flattened or even down-curled by the applied moisture prior to entry into the gap between the print head 20 and the transport belt 34 as shown in FIG. 1. Depending on the distance 12 between the moisture source 50 and the ink jet head(s) 20, the optional dryer 70 may be controlled by the controller 40 (e.g., with adjustable drying air (blower) speed and/or adjustable applied heat) to dry the cut sheets 62 so as to mitigate any dampness-related adverse effects on the printing process, and without adversely affecting the decurling process. Accordingly, the dryer 70 and the moisture source 50 may be operated and controlled in a coordinated fashion along with control of the sheet feed speed by the controller 40 to facilitate proper capture of the leading edge 62a of the sheets 62 and control over the sheet flatness in combination with the transport mechanism 30 to control the overall printing process in the system 10.

In certain implementations, moreover, the droplet or mist spray 54 may not be continuous, and may be controlled by the controller 40 to provide moisture to less than all of the top side of the cut sheets 62. In one preferred embodiment of this aspect of the disclosure, moisture is provided to a portion of the sheet top side that includes the leading edge of the sheets 62 to combat upwardly curled sheets 62 provided from the upstream transport mechanism 60. In one example, the moisture may be selectively provided to the leading edge 62*a* of the cut sheets 62 and a small portion of the interior of the sheets 62 so as to avoid or mitigate the application of moisture to portions of the sheet 62 onto which printing ink is to be provided from the ink-jet printing head 20 (e.g., moistening only non-printed portions of the sheets 62.

In another aspect of the disclosure, moreover, the cut sheet transport system 30 is a vacuum sheet transport system having one or more vacuum blowers 36 (FIGS. 1 and 4) that provide a vacuum airflow to attract a second side of the cut sheets 62 toward the vacuum sheet transport system 30. As best illustrated in FIGS. 2-4, the belt 34 may include apertures 34*a* for providing an attractive pressure via the blower 36 to draw all or at least the leading edge of the cut sheets 62 downward toward the transport belt 34. As shown in FIG. 2, moreover, the transport 30 may be a multi-belt configuration with a plurality of transport belts 34 driven by a pair of rollers 32, at least one of the rollers 32 being controlled by a motor (not shown) receiving speed control signal(s) from the controller 40. Where the cut sheets 62 initially have an upward lead edge curl (e.g., the left most sheet 62 in FIG. 1), the sheet 62 may inadvertently be incompletely acquired by the vacuum transport 30, absent countermeasures of the present disclosure. In this case, the sheet 62 (or at least the leading edge thereof) encounters the droplets or mist 54 in the moisturizing zone 56 and the top side thereof is provided with moisture 54. This causes expansion of the top side fibers, resulting in the concave top side being reshaped into a flat shape or to a somewhat convex shape as shown in the three successive sheets in FIG. 1.

As best shown in FIG. 3, this downward force from the top side moisture facilitates the capture or acquisition of the leading edge 62*a* of the sheet 62 at the acquisition point where the vacuum belt 34 flattens, such that the lead end of the sheet 62 is attracted by the vacuum pressure and adheres to the belt(s) 34. Thereafter, as shown in FIG. 4, the sheet 62 remains adhered to the upper side of the belt 34 by the downward air pressure from the blower 36 via apertures 34*a*, thereby maintaining control over the vertical distance 18 between the top of the sheet 62 and the lower end of the printing head 20.

Figure 5:
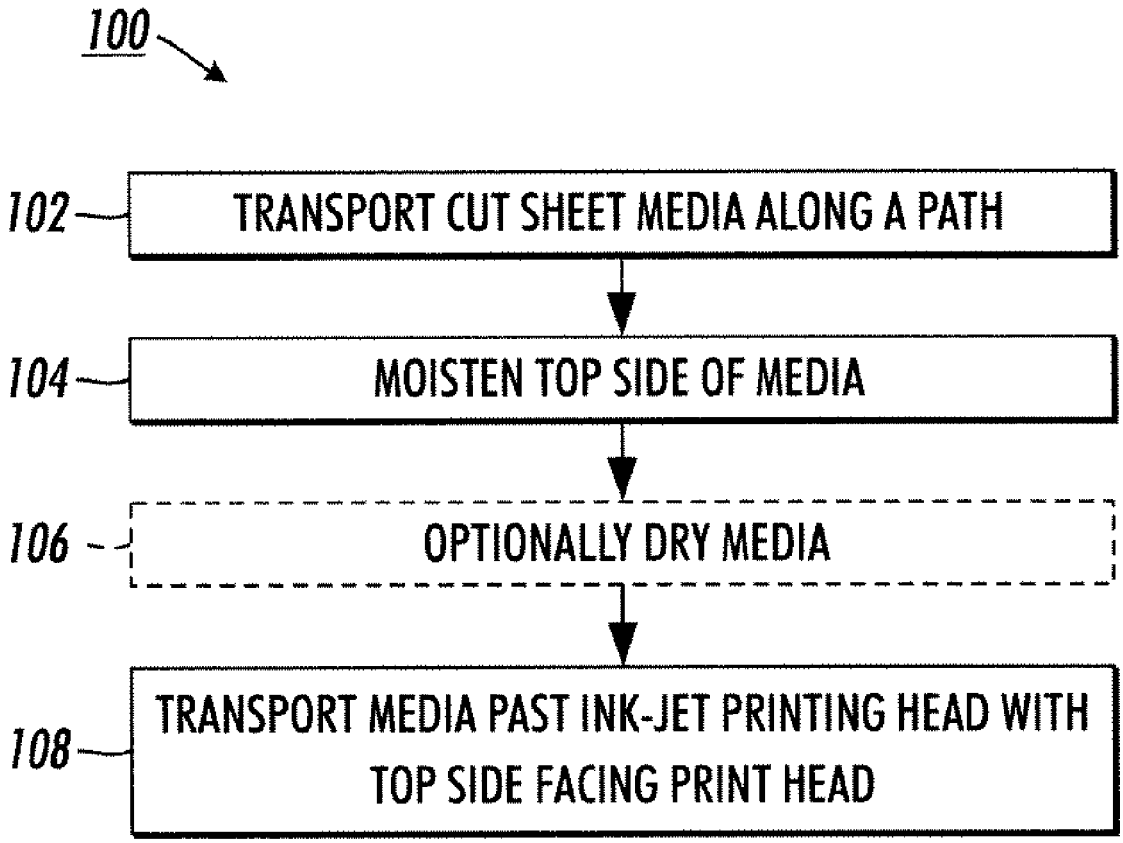
FIG. 5 is a flow diagram illustrating an exemplary method for decurling cut sheet print media in an ink-jet printing system in accordance with the disclosure.

Referring also to FIG. 5, an exemplary method 100 is depicted for decurling cut sheet print media for ink-jet printing in accordance with various aspects of the present disclosure. Although the exemplary method 100 is illustrated and described below in the form of a series of acts or events, it will be appreciated that the various methods of the disclosure are not limited by the illustrated ordering of such acts or events except as specifically set forth herein. In this regard, except as specifically provided hereinafter, some acts or events may occur in different order and/or concurrently with other acts or events apart from those illustrated and described herein, and not all illustrated steps may be required to implement a process or method in accordance with the present disclosure. The illustrated method 100 and other methods of the disclosure may be implemented in hardware, software, or combinations thereof, in order to provide the above described decurling operation in an ink-jet printing system such as those illustrated and described above, wherein the disclosure is not limited to the specific applications and implementations illustrated and described herein.

The method 100 begins at 102 in FIG. 5 with transportation of one or more cut sheets 62 along a path. All or a portion of the top side of the cut sheets 62 is moistened at 104 to decurl the cut sheets 62. The decurling at 104 may be by any suitable moisturizing technique, such as by directing water droplets or mist toward at least a portion of a first side of the cut sheets 62 in a moisturizing zone 56 extending across the path (e.g., as shown in FIGS. 1-3 above). In one embodiment, the decurling of the cut sheets at 104 includes directing water droplets or mist 54 toward less than all of the first side of the cut sheets 62 moving along the path, where the moistened portion preferably includes the leading edge 62*a* of the sheets 62. In certain embodiments, the method 100 optionally includes at least partially drying the cut sheets 62 at 106 after the decurling at 104 and before transporting the decurled cut sheets past the ink-jet printing head 20. At 108, the decurled cut sheet media is transported past an ink-jet printing head 20 with the first side of the cut sheets 62 facing the printing head 20 to receive ink droplets ejected by the printing head 20. The transportation at 108 in one embodiment includes providing vacuum force attracting a second side of the cut sheets 62, for instance, as in the vacuum transport system 30 in FIGS. 2-4 above.

The above examples are merely illustrative of several possible embodiments of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, software, or combinations thereof, which performs the specified function of the described component (i.e., that is functionally equivalent), even though not structurally equivalent to the disclosed structure which performs the function in the illustrated implementations of the disclosure. In addition, although a particular feature of the disclosure may have been disclosed with respect to only one of several embodiments, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising". It will be appreciated that various of the above-disclosed and other features and functions, or alternatives thereof, may be desirably combined into many other different systems or applications, and further that various presently unforeseen or unanticipated alternatives, modifications, variations or improvements therein may be subsequently made by those skilled in the art which are also intended to be encompassed by the following claims.

The invention claimed is:

1. A printing system, comprising:

at least one ink-jet printing head operative to eject ink droplets toward a printable media path;

a cut sheet transport system spaced from the printing head and operative to transport one or more cut sheets along the path with a first side of the cut sheets lacing the printing head to receive ejected ink droplets; and a moisture source with an outlet spaced from the path and operative to direct water droplets or mist toward at least a potion of the first side of the one or more cut sheets moving along the path in a moisturizing zone extending across the path upstream from the printing head.

2. The printing system of claim 1, wherein the moisturizing zone extends across the path upstream from the cut sheet transport system.

3. The printing system of claim 1, further comprising a controller operatively coupled with the cut sheet transport system and with the moisture source to control a sheet transport speed of the transport system and to control an amount of moisture transferred to the cut sheets.

4. The printing system of claim 3, wherein the moisture source is operative to direct water droplets or mist toward less than all of the first side of the cut sheets moving along the path.

5. The printing system of claim 1, wherein the moisture source is operative to direct water droplets or mist toward less than all of the first side of the cut sheets moving along the path.

6. The printing system of claim 5, wherein the moisture source is operative to direct water droplets or mist toward a leading edge of the first side of the cut sheets moving along the path.

7. The printing system of claim 1, further comprising a dryer spaced from the path between the moisture source and the printing head and operative to at least partially dry the one or more cut sheets moving along the path downstream of the moisturizing zone.

8. The printing system of claim 1, wherein the moisture source is operative to direct water droplets or mist toward only a leading edge of the first side of the cut sheets moving along a path.

9. The printing system of claim 8, wherein the moisturizing zone overlies a portion of a belt of the cut sheet transport system beyond a flat portion of the belt.

10. The printing system of claim 1, wherein the moisturizing zone overlies a portion of a belt of the cut sheet transport system beyond a flat portion of the belt.

11. A method of decurling cut sheet print media for ink-jet printing, the method comprising:

transporting one or more cut sheets along a path;

decurling the cut sheets by directing water droplets or mist toward at least a portion of a first side of the cut sheets in a moisturizing zone extending across the path; and transporting the decurled cut sheets past an ink-jet printing head with the first side of the cut sheets facing the printing head to receive ink droplets ejected by the printing head.

12. The method of claim 11, wherein decurling the cut sheets comprises directing water droplets or mist toward less than all of the first side of the cut sheets moving along the path.

13. The method of claim 12, wherein transporting the decurled cut sheets past the ink-jet printing head comprises providing vacuum force attracting a second side of the cut sheets.

14. The method of claim 12, wherein decurling the cut sheets comprises directing water droplets or mist toward a leading edge of the first side of the cut sheets moving along the path.

15. The method of claim 11, further comprising controlling a sheet transport speed at which the cut sheets are transported along the path and controlling an amount of moisture transferred to the cut sheets.

16. The method of claim 11, further comprising at least partially drying the cut sheets after decurling and prior to transporting the decurled cut sheets past the ink-jet printing head.

17. The method of claim 11, wherein decurling the cut sheets comprises directing water droplets or mist toward only a leading edge of the first side of the cut sheets moving along the path.

18. The method of claim 17, wherein the moisturizing zone overlies a portion of a belt of a cut sheet transport system beyond a flat portion of the belt.

19. The method of claim 11, wherein the moisturizing zone overlies a portion of a belt of a cut sheet transport system beyond a flat portion of the belt.

* * * * *